US005402558A

United States Patent [19]

Santapa

[11] Patent Number: 5,402,558

[45] Date of Patent: Apr. 4, 1995

[54] RESILIENT CLIP

[75] Inventor: Frank J. Santapa, Rosemont, Ill.

[73] Assignee: Selfix, Inc., Chicago, Ill.

[21] Appl. No.: 239,734

[22] Filed: May 9, 1994

[51] Int. Cl.[6] ..... A44B 21/00

[52] U.S. Cl. ..... 24/511; 24/501; 24/557; 24/565; 223/91

[58] Field of Search ..... 24/511, 499, 557, 543, 24/562, 530, 565, 507, 501; 223/91

[56] References Cited

U.S. PATENT DOCUMENTS

| | | | |
|---|---|---|---|
| Re. 32,269 | 10/1986 | Bisk et al. | 223/91 |
| D. 175,169 | 7/1955 | Jacobson | D80/8 |
| D. 251,345 | 3/1979 | Bigelow et al. | D6/257 |
| D. 264,662 | 6/1982 | Bisk et al. | D6/257 |
| D. 301,661 | 6/1989 | Wilson | D6/326 |
| D. 307,833 | 5/1990 | Maki | D6/326 |
| D. 316,333 | 4/1991 | Maki | D6/328 |
| 454,579 | 6/1891 | Lamb . | |
| 1,151,556 | 8/1915 | Barney . | |
| 1,358,560 | 11/1920 | Kennison . | |
| 1,684,721 | 9/1928 | Wood . | |
| 1,750,905 | 3/1930 | Schilpp . | |
| 1,893,508 | 1/1933 | Rosenberg . | |
| 1,905,958 | 4/1933 | Bogley . | |
| 2,496,109 | 1/1950 | Terry | 24/137 |
| 2,506,510 | 5/1950 | Longwell et al. | 223/91 |
| 2,569,371 | 9/1951 | Cohen | 24/252 |
| 2,583,784 | 1/1952 | Maccaferri | 223/91 |
| 2,583,996 | 1/1952 | Cavanagh | 223/96 |
| 2,613,857 | 10/1952 | Pechtel | 223/91 |
| 2,666,240 | 1/1954 | Maccaferri | 24/137 |
| 2,723,786 | 11/1955 | Martin | 223/91 |
| 2,782,482 | 2/1957 | Baril et al. | 24/252 |
| 2,802,610 | 8/1957 | De Lier | 223/91 |
| 2,910,753 | 11/1959 | Carbauh | 24/138 |
| 3,018,026 | 1/1962 | Binkley et al. | 223/91 |
| 3,203,061 | 8/1965 | Thomas | 24/81 |
| 3,214,813 | 11/1965 | Goldman | 24/137 |
| 3,239,902 | 3/1966 | Cohen | 24/137 |
| 3,456,262 | 7/1969 | Coon | 24/137 |
| 3,950,829 | 4/1976 | Cohen | 211/124 |
| 4,009,807 | 3/1977 | Coon | 223/96 |
| 4,382,531 | 5/1983 | Bisk et al. | 223/91 |
| 4,660,750 | 4/1987 | Blanchard | 223/91 |
| 4,701,983 | 10/1987 | Warmath | 24/511 |
| 4,878,276 | 11/1989 | Morrish et al. | 24/511 |
| 5,075,935 | 12/1991 | Abdi | 24/511 |
| 5,241,728 | 9/1993 | Hunter | 24/511 |

FOREIGN PATENT DOCUMENTS

| | | |
|---|---|---|
| 1159796 | 7/1958 | France . |
| 1210426 | 3/1960 | France . |
| 348684 | 5/1937 | Italy . |
| 50-57635 | 5/1975 | Japan . |
| 54-43859 | 12/1979 | Japan . |
| 7306492 | 11/1974 | Netherlands . |
| 277009 | 11/1951 | Switzerland . |
| 278907 | 2/1952 | Switzerland . |
| 352309 | 4/1961 | Switzerland . |
| 504574 | 4/1971 | Switzerland . |
| 302326 | 1/1928 | United Kingdom . |
| 593125 | 10/1947 | United Kingdom . |
| 697866 | 9/1953 | United Kingdom . |
| 714990 | 9/1953 | United Kingdom . |
| 731906 | 6/1955 | United Kingdom . |
| 1031886 | 1/1966 | United Kingdom . |

*Primary Examiner*—Victor N. Sakran
*Attorney, Agent, or Firm*—Dressler, Goldsmith, Shore & Milnamow, Ltd.

[57] ABSTRACT

A resilient clip or spring clip is disclosed which has a pair of jaw members and a generally U-shaped biasing member for connecting the jaws together and for biasing the jaws into a closed position. The biasing member has a pair of legs connected by a curvilinear central portion and a curvilinear support portion interior thereof. The central portion and support portion are connected by a bridge-like member, and define a channel therebetween. The sidewall of each jaw member has a closed sidewall extending along a substantial portion thereof and defines an arcuate surface. During actuation of the clip, the sidewall traverses through the channel in the biasing member, while the support portion defines and serves as a fulcrum for rotation of the jaws between the open and the closed positions, independently of any separate support member.

14 Claims, 2 Drawing Sheets

RESILIENT CLIP

FIELD OF THE INVENTION

This invention relates generally to resilient clips and more particularly to resilient clips which are capable of being used while attached to a support member, such as a hanger, and which are also capable of being used independently thereof.

BACKGROUND OF THE INVENTION

Spring clips or resilient clips are available in various configurations and materials. Many such clips are adapted to be used with an associated support rod, such as clothes hangers and the like, and are designed to be pivotally attached thereto. In such designs, the rod acts not only as a pivot for the clip, but also as an integral component of the clip device. Such clips are disclosed in Bisk et al. U.S. Pat. No. Re 32,269 and Morish et al. U.S. Pat. No. 4,878,276.

In many spring clip arrangements which are adapted for use with a support rod, such as the cross bar of a hanger, the support rod is necessary to use the clip as intended. The support bar acts as the fulcrum or pivot point for the clip and further provides structural stability to the clip by maintaining the spring or biasing member in tension. If the clip is not assembled to the support bar, the clip components have no means by which to remain in an assembled configuration. Thus, once the clip is removed from the support bar, the clip components are easily separated and frequently lost, rendering the clip unusable.

Efforts have been made to design spring clips which do not require a support rod to properly function. Such clips include independent pivot support means to provide a fulcrum for the clips, the fulcrum point typically being displaced from the axis of rotation of the clip. The unreliability and complexity of many clips, which are intended to operate with and without a support rod, have detracted from the clip's usefulness and satisfactory operation.

Many of the problems with clip designs were addressed by the clip disclosed in Hunter, U.S. Pat. No. 5,241,728, which patent is commonly assigned herewith, and which patent is incorporated by reference hereby. The Hunter patent discloses a resilient clip which is constructed of a minimum number of parts and which clip pivots about a point that remains unchanged whether the clip is used with a support rod or independently thereof. The clip disclosed in Hunter also remains assembled when used with or without a support rod. The clip disclosed in the Hunter patent may be difficult to operate, and can become inadvertently disassembled. In addition, the spring member is not independently secured to either jaw other than as part of the assembly with both jaws in place.

It would be desirable therefore to provide a spring clip or resilient clip which is capable of being supported on a support rod such as a hanger cross bar and which is also capable of use independently thereof. It would also be desirable for such clip to be easily used, constructed of a minimum number of parts, and for the spring of the clip to be independently retained or engaged to either jaw of the clip, even when the opposing jaw is not in place, i.e., when the clip is partially disassembled.

SUMMARY OF THE INVENTION

In accordance with the present invention, a spring clip is disclosed which has a minimum number of parts, and which clip is capable of being assembled to pivot about an axis which remains unchanged whether or not the clip is attached to a separate support member.

A spring clip which incorporates the present invention comprises a pair of jaw members and a generally U-shaped resilient biasing member. Each jaw member has a first gripping end portion adapted to engage the corresponding first gripping end portion of the other jaw member for gripping an article or object therebetween, a second end portion defining a manually actuatable portion, and an intermediate portion having an enclosed sidewall and defining an arcuate surface.

The generally U-shaped resilient biasing member is independently engageable with each of said jaw members and is engageable with the pair of jaw members for resiliently urging the gripping end portions into engagement with each other.

The biasing member includes a pair of legs and a curvilinear base portion integral with and joining the legs, and has a width adapted to fit between the intermediate portions of the jaw members adjacent the enclosed sidewall. Each of the legs extends respectively along an outer surface of the sidewall and is engageable with its respective jaw member at a position adjacent to the first gripping end portion with the curvilinear base portion extending between the jaw members.

The biasing member further includes a curvilinear support portion extending laterally out from, and integral with, the biasing member adjacent the curvilinear base portion. The curvilinear support portion and the curvilinear base portion define a curvilinear channel therebetween to permit the sidewall to arcuately traverse therethrough. The curvilinear support portion typically extends laterally along the axis of rotation a width greater than the width of the legs. The support portion is engageable by the arcuate surfaces of the intermediate portions of the jaws for defining a fulcrum therefor about an axis of rotation passing between the legs and within the curvilinear support portion.

The jaw members pivot about the axis of rotation along the surface of the fulcrum for separating the gripping end portions in response to pressure on the manually actuatable portions one toward the other and for moving the gripping end portions toward each other in response to a force applied by the biasing member when the manually actuatable portions are released.

The closed sidewalls of the jaw members permit the biasing member to be independently engaged with, and secured to, either jaw member, without the opposing jaw member in place. This provides greater resistance to separation and disengagement of the jaw members from the biasing member.

In a preferred embodiment, each jaw member further includes a detent formed in the outer surface of the intermediate portion adjacent the gripping end portion. In the preferred embodiment, each of the legs of the U-shaped biasing member further includes a hook portion to engage the detent.

The curvilinear support portion defines an axial opening therein which is adapted to receive a rod member, such as the rod portion of a hanger, for selectively supporting the clip on the rod member which is inserted within the axial opening.

Numerous other features and advantages of the present invention will become readily apparent from the following detailed description of the invention and an embodiment thereof, from the claims, and from the accompanying drawings in which the details of the invention are fully and completely disclosed as part of this specification.

DETAILED DESCRIPTION OF A PREFERRED EMBODIMENT

Figure 1:
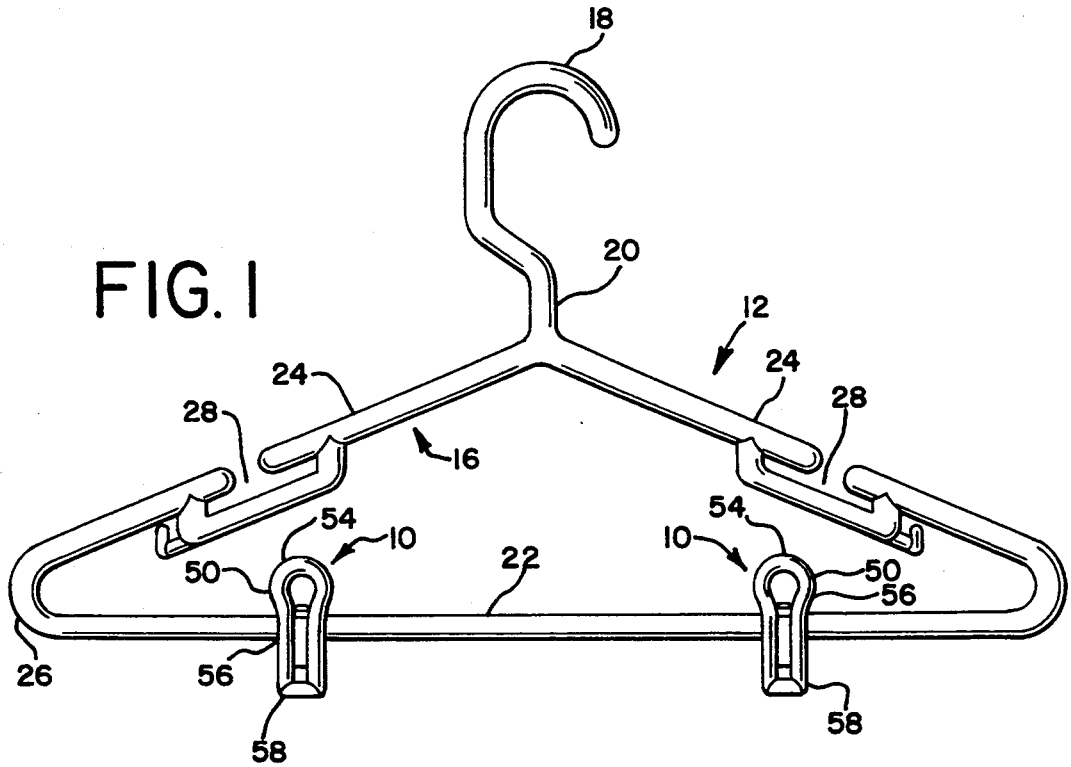
FIG. 1 is a plan view of an all plastic hanger, such as a garment hanger, showing the engagement therewith of a spring clip constructed in accordance with the principles of the present invention.

While the present invention is susceptible of embodiment in various forms, there is shown in the drawings and will hereinafter be described a preferred embodiment of the invention with the understanding that the present disclosure is to be considered as an exemplification of the principles of the invention and is not intended to limit the invention to the specific embodiment illustrated.

With reference to the drawings, and particularly to FIG. 1, there is shown a clip 10 incorporating the present invention, as the clip 10 is used with an associated support bar such as the exemplary hanger 12. Such a hanger typically includes a body portion 16 and a supporting hook portion 18 for supporting or suspending the hanger 12 from a support rod, such as a curtain rod or closet rod, as is well known in the art. Typically, a hanger 12, such as that illustrated in FIG. 1, has a cylindrical cross section. The body portion 16 has an upstanding neck 20 to which is connected the hook portion 18, a cross bar 22, and a pair of arms 24. The arms 24 merge together at the neck 20, and diverge downward therefrom to join the cross bar 22 at a rounded shoulder 26.

The diverging arms 24 provide a support for a jacket or similar garment. The arms 24 may also include a slot 28 for supporting garments having straps or the like which would otherwise tend to slip from the arms 24.

Hangers such as that illustrated in FIG. 1 may be used with spring clips, as is well known in the art. Typical of such spring clips is that disclosed in the aforementioned U.S. Pat. No. Re 32,269, which clips use the support bar as a fulcrum for the clip and which support bar then serves as an integral part of the functioning clip.

The novel clip 10 described herein may be similarly attached to a hanger cross bar 22 or the clip 10 may be used independently therefrom. The clip 10 of the present invention, as best seen in FIGS. 2 through 5, comprises a pair of substantially identical levers or jaw members 50 and a biasing or spring member 52 which connects the jaws together and which serves as a fulcrum and a support about which the jaws 50 pivot, as described herein.

Each of the jaws 50 is formed of a plastic material, such as polypropylene and the like, while the biasing or spring member 52 may be formed from a different material, such as polycarbonate, such materials being recognized by those skilled in the art.

Each of the jaw members 50 is formed as a substantially planar member having an enlarged manually actuatable end portion 54, an intermediate portion 56, and a gripping end portion 58. The intermediate portion 56 has a closed sidewall 60 extending along a substantial portion thereof, and defines a curvilinear or arcuate surface 62 on the interior side of the jaw member 50 when the clip 10 is viewed in an assembled fashion.

Figure 3:
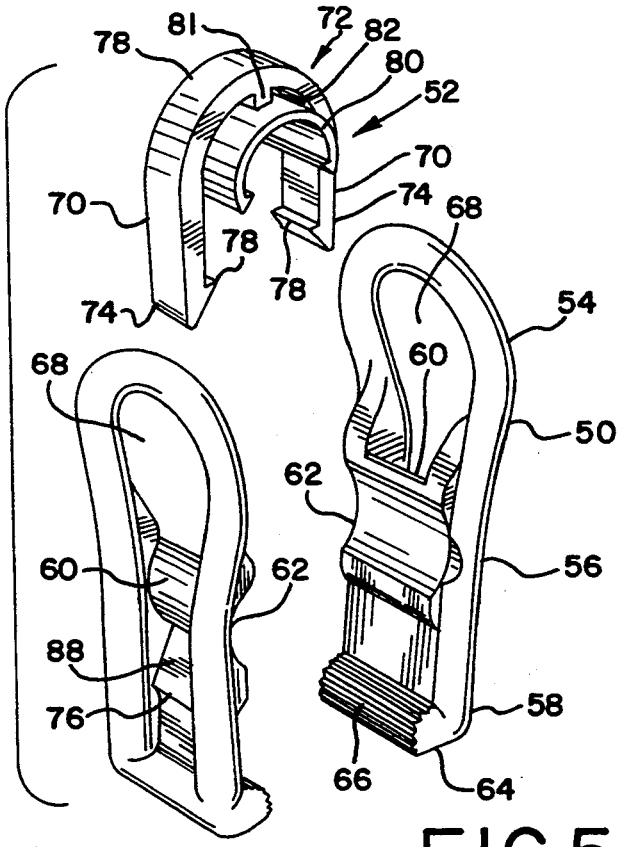
FIG. 3 is an exploded perspective view of the clip illustrated in FIG. 2.
Figure 4:
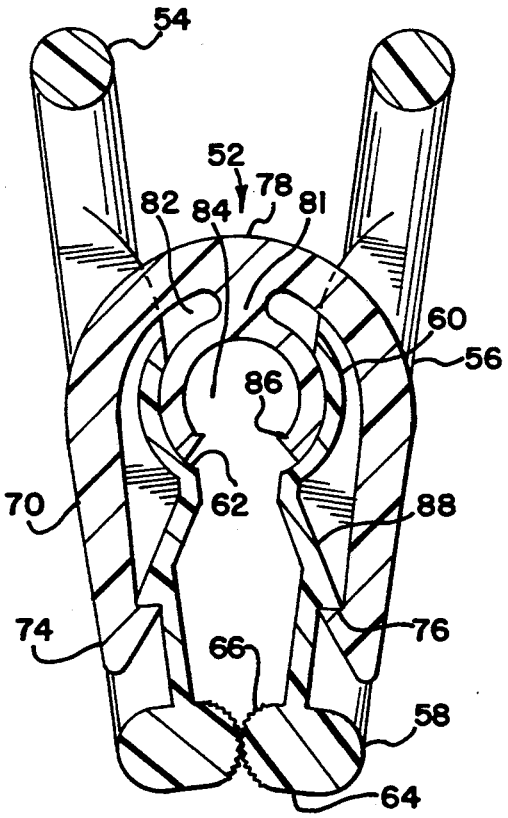
FIG. 4 is an enlarged sectional view taken along line 4—4 of FIG. 2 with the clip shown in the closed or griping position.
Figure 5:
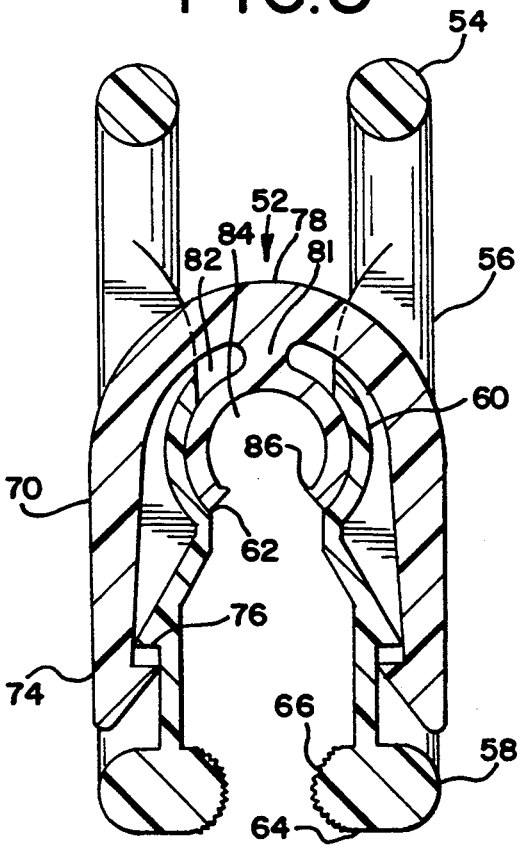
FIG. 5 is a view similar to FIG. 4 with the clip shown in the open position.

The gripping end portion 58 may have a projection 64 extending inwardly therefrom, as best shown in FIGS. 3 through 5. The surface of the projection 64 may include ridges or serrations 66 to frictionally secure a garment or other object in the clip 10.

The jaws 50 are disposed side by side. Each jaw 50 includes an opening 68 extending from the manually actuatable portion 54 along a part of the intermediate portion 56 to the closed sidewall 60. The opening 68 receives the legs 70 of the resilient biasing means or U-shaped spring clip portion 72 of the spring member 52. The legs 70 pass through the opening 68 with the free ends 74 of the legs 70 each engaging a shoulder or detent 76 on the outer surface of the sidewall 60 adjacent the gripping end portion 58. In a preferred embodiment, the free end 74 includes a hook portion 78 which positively engages the detent 76.

Figure 2:
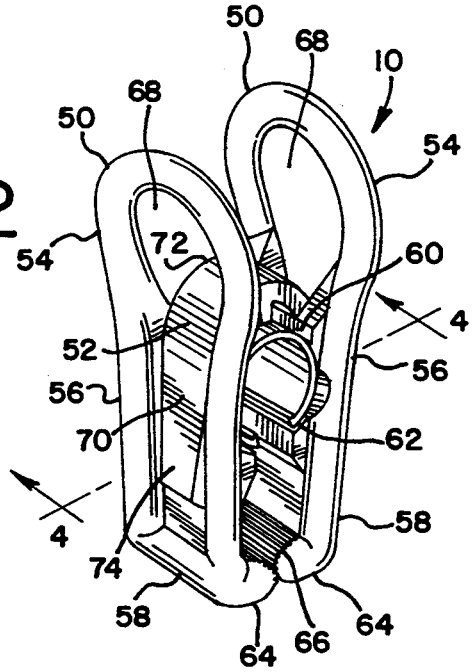
FIG. 2 is a perspective view of a spring clip incorporating the present invention.

The width of the legs 70 of the U-shaped clip 72 is such as to pass through the openings 68 and over the closed sidewall portions 60. The legs 70 are joined by a curvilinear or arcuate central or base portion 78. The spring member 52 further includes an arcuate support portion 80, spaced from and interior to the clip 72, and joined thereto by a bridge-like member 81. In a preferred construction, the biasing member 52 is formed as a single component, such as in a molding process. The arcuate support portion 80 is generally coaxial with the central portion 78, as best seen in FIG. 4. The central portion 78 and support portion 80 define an arcuate or curvilinear channel 82 therebetween. The support portion 80 extends laterally beyond the width of the legs 70, as best seen in FIGS. 2 and 3.

When the clip 10 is assembled, the configuration of the U-shaped spring clip 72 permits the closed sidewall 60 to be partially positioned in the channel 82, between the central portion 78 and the support portion 80. In this manner, the outer surfaces of the support portion 80 engage the corresponding opposed arcuate intermediate surfaces 62 of each jaw member, as best shown in FIGS. 4 and 5. The support portion 80 thus defines a fulcrum and pivot surface about which the jaws 50 rotate.

When the clip 10 is actuated between the gripping position, as shown in FIG. 4, and the open position, as shown in FIG. 5, the sidewall portion 60 will arcuately traverse through the channel 82 from a lowermost point when the clip 10 is in the gripping position, to an uppermost point when the clip 10 is in the open position. With reference to FIG. 5, when the clip 10 is actuated to the open position, the free ends 74 of the legs 70 traverse or slide along the intermediate portions 56 of the jaw members 50, in a direction toward the gripping end portions 58, and away from the detents 76.

Moreover, when the clip 10 is actuated to the open position, the support portion 80 tends to move slightly inward (i.e., reduce diameter) and pinch the associated cross-bar 22. This is due to the pressure exerted by the jaw members 50 on the support portion 80 surfaces, as they pivot thereabout. Conversely, when pressure on the actuatable end portion 54 is released and the clip 10 returns to the gripping position, as shown in FIG. 4, the support portion 80 returns to its original shape due to the reduced pressure, and the support portion's 80 resiliency.

Further, the configuration of the clip 10, having the closed sidewall portion 60 disposed in the channel 82, permits the biasing member 52 to be independently or individually secured to either jaw member 50, without the opposing jaw member 50 in place. This arrangement facilitates assembly of the clip 10 and reduces the opportunity to misplace or lose the biasing member 52 when the clip 10 is not fully assembled, or when the clip 10 is disassembled. This arrangement also provides greater resistance to separation and disengagement of the jaw members 50 from the biasing member 52.

The arcuate support member 80 defines an arcuate recess or axial opening 84 formed therewithin which extends along the axis of rotation. The axial opening 84 is adapted to permit insertion of a suitable support member or rod, such as the exemplary support rod 22 of hanger 12, into the clip 10. The support member 80 thus retains the rod 22 securely therein, independent of the use or actuation of the clip 10. The support member 80 may further include projections 86 to facilitate retention of the support rod therein. As is evident, however, the assembled clip 10 is independently operable by virtue of the jaws 50 pivoting about the arcuate fulcrum of the support member 80.

The opposed gripping end portions 58 of the jaws 50 form a nip of the clip with the projections 64 engageable against each other to retain an article therebetween. The opposed manually actuatable portions 54 are designed to be grasped and pressed together to open the gripping end portions 58 and allow insertion of an article. Upon release of the pressure on the manually actuatable portions 54, the biasing member 52 effects rotation or pivoting of the jaw members 50 about the support portion 80 to force the gripping end portions 58 toward each other to close the clip 10.

The outer surface of the sidewall portion 60 of the intermediate portion 56 of each jaw member 50 may include an inclined or ramped surface 88 extending along the sidewall portion 60 to the detent 76. The inclined surface 88 facilitates assembly of the clip 10.

Another advantage of the clip 10 of the present invention is that the support portion 80 retains its grip or securement on an associated support rod, such as a hanger cross bar 22 when the clip 10 is actuated between the closed or gripping position and the open position. Moreover, because of the interaction of the curvilinear surfaces 62 and the support portion 80 as the surfaces 62 pivot thereon, the grip of the support portion 80 on the cross bar 22 may tend to increase and thus resist sliding and disengagement therefrom.

Once assembled, the clip 10 can be readily snapped onto a suitable support rod, such as a hanger cross bar. Although the clip 10 may be used without the associated support rod. If desired, an alternate support may be used. Alternatively, the clip may be used without any support member and may be hung from a hook or the like passing through the aperture formed in the manually actuatable end thereof.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A clip comprising:

a pair of jaw members each having a first gripping end portion adapted to engage the corresponding first gripping end portion of the other jaw member for gripping an article or object therebetween;

a second end portion defining a manually actuatable portion; and an intermediate portion having a closed sidewall extending along a substantial portion thereof and defining an arcuate inner surface; and a generally U-shaped resilient biasing member independently engageable with each of said jaw members and engageable with the pair of jaw members for resiliently urging said first end portions into engagement with each other, said biasing member having a pair of legs and a curvilinear central base portion integral with and joining said legs, said legs having a width adapted to pass through a space formed in said jaws and extending along said intermediate portions of said jaw members adjacent said closed sidewall, each of said legs extending respectively along an outer surface of said closed sidewall and being engageable with its respective jaw member at a position adjacent to said first gripping end portion with said curvilinear base portion extending between said jaw members, and a curvilinear support portion disposed internally of and connected to said biasing member adjacent said curvilinear base portion, said support portion and said base portion defining a curvilinear channel therebetween for receiving said closed sidewall of said intermediate portion of each said jaw member, said support portion engaging said arcuate surfaces of said intermediate portions of said jaws for defining a fulcrum therefor about an axis of rotation passing between said legs and within said curvilinear support portion, said jaw members pivoting about said axis of rotation along the surface of said fulcrum for separating said gripping end portions in response to pressure on said manually actuatable portions one toward the other and for moving said gripping end portions toward each other in response to the biasing force of said biasing member when said manually actuatable portions are released.

2. The clip of claim 1 wherein each jaw member further includes a detent formed in the outer surface of said closed sidewall of said intermediate portion adjacent said first gripping end portion, and the ends of each of the legs of the U-shaped biasing member engage said detent.

3. The clip of claim 1 wherein the curvilinear support portion extends laterally along the axis of rotation a width greater than the width of the legs of said biasing member.

4. The clip of claim 1 wherein the curvilinear support portion defines an axial opening therein being adapted to receive a rod member for selectively supporting the clip on a rod member inserted within the axial opening.

5. The clip of claim 1 wherein said central portion and said support portion are connected by a bridge-like member.

6. A clip comprising:

a pair of jaw members; and a generally U-shaped fulcrum defining spring member independently engageable with each of said jaw members, said spring member defining a pair of legs connected by an integral arcuate central portion defining an arcuate recess between said legs, and an arcuate support portion interior of, spaced from, and connected to the central portion and being generally coaxial therewith, said central portion and said support portion defining a channel therebetween, said support portion defining a pair of opposed fulcrum support surfaces;

each of said jaw members having a closed sidewall extending along a substantial portion thereof and defining an arcuate surface intermediate the ends thereof, said arcuate surface being engageable with said support portion of said spring member and being pivotal thereon, said legs of said spring member passing between said jaw members to engage outer surfaces of said closed sidewall adjacent one end thereof, the ends of said legs of said spring member being engageable with the outer surfaces of said closed sidewalls of said jaw members adjacent said first ends thereof for biasing said first ends toward each other to engage said first ends one with the other, said jaw members being operated by pressure applied to the opposite ends thereof for pivoting said jaw members about the axis of rotation defined by said arcuate support portion as passing through said arcuate recess within said spring member.

7. The clip of claim 6 wherein the closed sidewall of each jaw member includes an inclined outer surface and a detent disposed on the inclined surface, and each of the legs of the U-shaped biasing member includes a hook portion for engaging said detent.

8. The clip of claim 6 wherein the curvilinear support portion defines an axial opening therein being adapted to receive a rod member for selectively supporting the clip on a rod member inserted within the axial opening.

9. The clip of claim 6 wherein said central portion and said support portion are connected by a bridge-like member.

10. A clip comprising:

a pair of jaw members each having a first gripping end portion, a second end portion, and a curvilinear intermediate portion having a closed sidewall extending along a substantial portion thereof;

a one-piece generally U-shaped resilient biasing member engageable with the pair of jaw members for resiliently urging said first gripping end portions into engagement with each other;

said biasing member including a pair of legs and a curvilinear central portion integral with and joining said legs, said curvilinear central portion and a portion of the legs of said biasing member being disposed between said jaw members and a portion of said legs extending through said jaws along said sidewalls to a point respectively along outer surfaces thereof, the free ends of said legs being engageable with said outer surfaces of said sidewalls at a position adjacent to said first end portions thereof, said U-shaped resilient biasing member further including a curvilinear support portion interior thereof and generally coaxial with the central portion thereof, the support portion being connected to the central portion and defining a curvilinear channel therebetween to receive the closed sidewall;

the intermediate portions of said jaw members shaped to rotatably engage the surface of said curvilinear support portion of said biasing member which defines a fulcrum therefor about an axis of rotation passing between said leg portions and within said curvilinear support portion of said biasing member, said jaw members being pivotal about said axis of rotation along the surface of said fulcrum defining curvilinear support portion in response to pressure applied to said second end portions, one toward the other for separating said first end portions and for effecting movement of said first end portions toward each other in response to the force of said biasing member when said second end portions are released.

11. The clip of claim 10 wherein the closed sidewall of each jaw member includes an inclined surface on the outer surface thereof and a detent disposed on the inclined surface, and the free ends of each of the legs of the U-shaped biasing member includes a hook portion to engage the detent.

12. The clip of claim 10 wherein the curvilinear support portion defines an axial opening therein being adapted to receive a rod member for selectively supporting the clip on a rod member inserted within the axial opening.

13. The clip of claim 10 wherein each jaw member is individually secured to the generally U-shaped resilient biasing member.

14. The clip of claim 10 wherein said central portion and said support portion are connected by a bridge-like member.

* * * * *